US006129953A

United States Patent [19]

Mertens

[11] Patent Number: 6,129,953

[45] Date of Patent: Oct. 10, 2000

[54] PROCESS FOR COATING A TITANIUM GOLF CLUB HEAD AND MANUFACTURE OF TITANIUM INSERTS

[75] Inventor: Peter Mertens, Naperville, Ill.

[73] Assignee: PureSpin Golf Company, Inc., Oswego, Ill.

[21] Appl. No.: 09/288,443

[22] Filed: Apr. 8, 1999

[51] Int. Cl.[7] ..... B05D 3/02; B05D 3/04; A63B 53/04

[52] U.S. Cl. ..... 427/376.6; 427/201; 427/350; 427/377; 427/374.1; 427/398.4; 473/342; 473/349

[58] Field of Search ..... 427/201, 350, 427/377, 376.6, 383.7, 374.1, 398.4; 473/324, 342, 349

[56] References Cited

U.S. PATENT DOCUMENTS 3,736,995 6/1973 Salter ..... 175/330
3,989,861 11/1976 Rasmussen .
4,768,787 9/1988 Shira ..... 273/175
4,917,384 4/1990 Caiati .
4,951,953 8/1990 Kim .
5,207,427 5/1993 Saeki .
5,407,202 4/1995 Igarashi ..... 273/169
5,620,382 4/1997 Cho et al. ..... 473/331
5,851,158 12/1998 Winrow et al. ..... 473/330

*Primary Examiner*—Shrive Beck
*Assistant Examiner*—Michael Barr
*Attorney, Agent, or Firm*—Cantor Colburn LLP

[57] ABSTRACT

In accordance with the present invention, a process for coating a titanium or titanium alloy golf club head is presented, wherein a brazing composition is securely adhered to the titanium or titanium alloy golf club head, preferably on the striking surface thereof. The brazing composition is disposed on the titanium striking surface and the golf club head is subjected to a vacuum furnace process. The vacuum process of the present invention is designed so that the brazing composition including the plurality of hard particles is securely bonded to the titanium striking surface to form a hard, durable striking surface on the golf club head.

17 Claims, 3 Drawing Sheets

PROCESS FOR COATING A TITANIUM GOLF CLUB HEAD AND MANUFACTURE OF TITANIUM INSERTS

BACKGROUND OF THE INVENTION

1. Field of the Invention

The present invention relates to a golf club head and more specifically to a process for coating a titanium or titanium alloy golf club head and to the manufacture of titanium inserts.

2. Brief Description of the Related Art

Over the years, more materials are being used to construct a golf club head of a golf club. Conventionally, the golf club head was formed of a cast metal and more specifically, the golf club head was formed of stainless steel. It is also known to fabricate a golf club head formed of several materials in which, typically, a face insert formed of a first material is disposed within a golf club head formed of a second material. The face insert is usually formed of a high strength, lightweight metal material, such as titanium.

In years past, the "woods " golf club heads, e.g., a driver or fairway wood, were actually made from wood; however, with the advent of metal "woods " in the golf club industry, the metal "woods " have become the clubs of choice. Metal woods are typically fabricated by investment casting techniques, usually from stainless steel or like metals. Even more recent, metal woods are fabricated from pure titanium or a titanium alloy. A large golf club head generally favors the use of pure titanium or titanium alloys because of their lightweights and high degree of tenacities.

One associated disadvantage of using either a golf club head formed of pure titanium or a titanium alloy or an insert formed from these materials is that a pure titanium material or a titanium alloy material is very difficult to work with and is very expensive. In addition, as is known in the art, it is extremely difficult to coat a titanium surface due to problems with adhering the coating material to the titanium surface. This results because a titanium surface rapidly oxidizes to produce an oxide on the titanium surface. The presence of the oxide creates a surface which prevents other materials from attaching thereto. Consequently, it has been essentially impossible or extremely difficult to coat or apply another material to a titanium surface, e.g., a titanium golf club head or a titanium face insert for use in a golf club head.

SUMMARY OF THE INVENTION

In accordance with the present invention, a process for coating a titanium or titanium alloy golf club head is presented, wherein a brazing composition is securely adhered to the titanium or titanium alloy golf club head, preferably in the form of a coating on the striking surface thereof. The process includes preparing a first composition which preferably comprises a combination of metal powders. More preferably, the first composition comprises a composition substantially formed of silver, nickel, copper, and titanium hydride powders. After mixing the powders and reducing the powders to a predetermined homogenous particle size, a plurality of hard particles is mixed with the first composition to form a second composition. Preferably, the plurality of hard particles 20 comprises diamond particles having a particle size from about 1 micron to about 40 micron. A first solution is added to the second composition to form the brazing composition of the present invention which initially is in the form a brazing slurry.

The brazing composition is disposed on the titanium striking surface of the golf club head and the golf club head is subjected to a vacuum furnace process. The vacuum process of the present invention is designed so that the brazing composition including the plurality of hard particles is securely bonded to the titanium striking surface to form a hard, durable striking surface on the golf club head.

In yet another aspect of the present invention, a process of manufacturing a titanium or titanium alloy insert having the brazing composition applied to a first surface is presented. The insert is designed to be received in an insert receiving recess formed in a forward face of the golf club head. The titanium insert may be used in both iron type golf clubs and woods type golf clubs.

The above-described and other features and advantages of the present invention will be appreciated and understood by those skilled in the art from the following detailed description, drawings, and appended claims.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
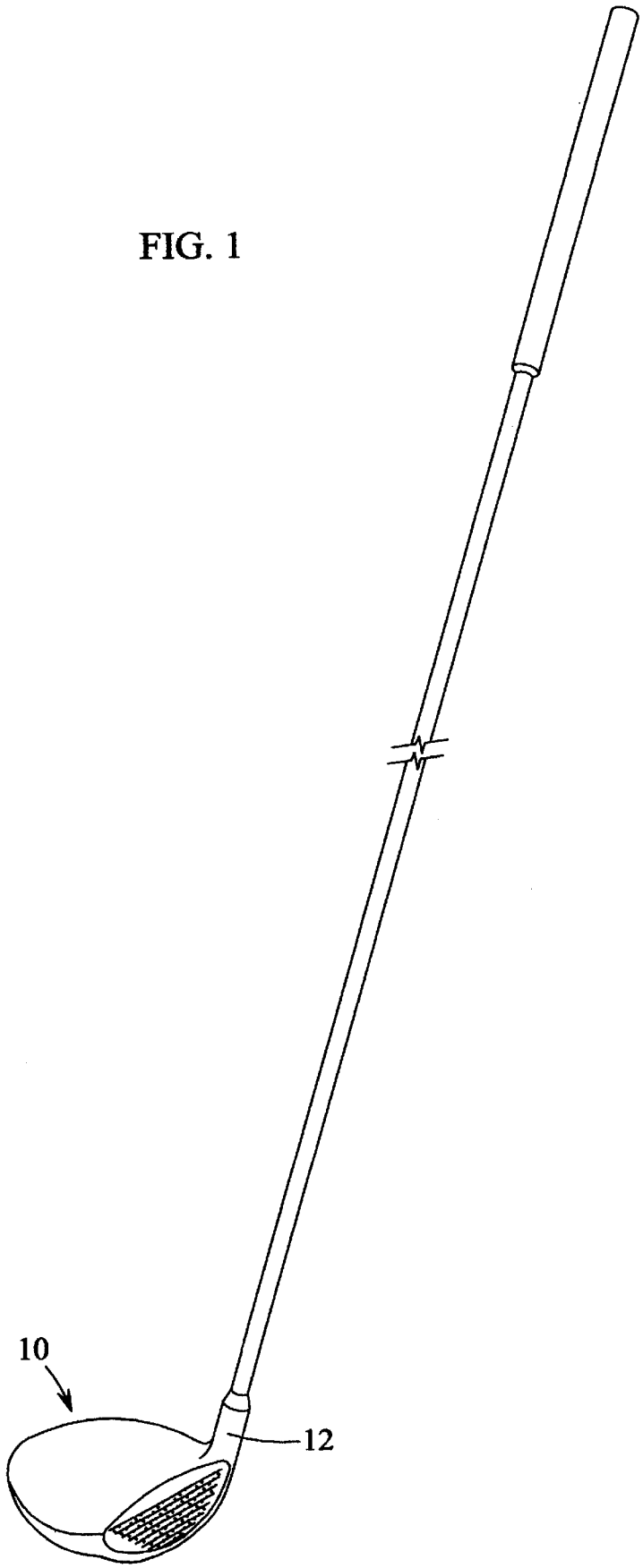
FIG. 1 is a front perspective of a golf club embodying the present invention.
Figure 2:
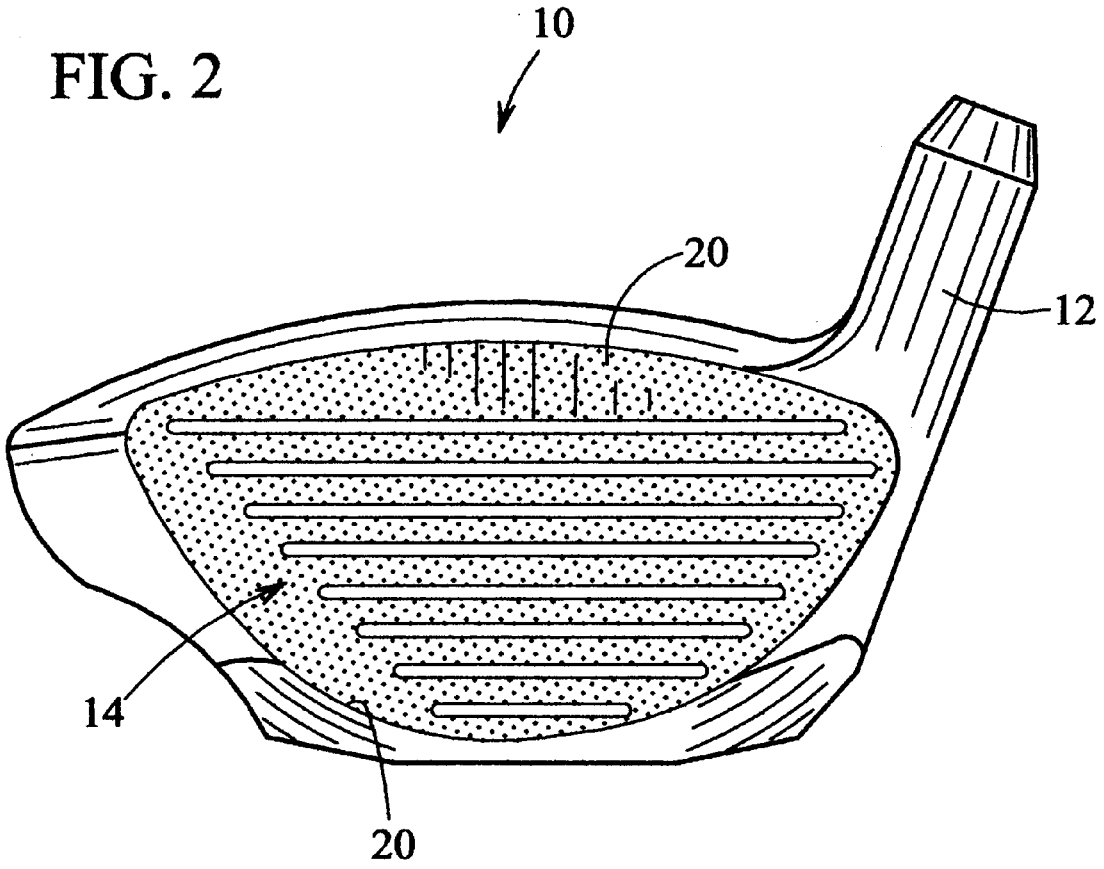
FIG. 2 is a front elevation view of a titanium or titanium alloy golf club head having a brazing composition applied to a striking surface thereof.

Referring to FIGS. 1 and 2, a golf club head embodying the present invention is generally indicated at 10. Golf club head 10 includes a hosel portion 12 and a striking surface 14. In accordance with the present invention, golf club head 10 is preferably made entirely of pure titanium or a titanium alloy. It being understood that it is within the scope of the present invention that golf club 10 may be formed of several shell components being formed from different materials. However, when several materials are used to fabricate golf club head 10, it is important that at least striking surface 14 be formed from pure titanium or a titanium alloy because the process of the present invention is designed to coat a titanium based striking surface 14. One exemplary titanium alloy is TI 6/4, i.e., 90% titanium, 6% vanadium and 4% aluminum. It being understood that any suitable titanium alloy may be used in accordance with the present invention to fabricate golf club head 10. It is further understood that golf club head 10 may comprise either an iron type club formed of titanium or a titanium alloy or a woods type club formed of the same.

As described hereinafter, the process of coating striking surface 14 relates to a process for coating a titanium striking surface 14. As used hereinafter, the term "titanium striking surface 14" comprises a striking surface 14 made from pure titanium or a titanium alloy. First, the titanium striking surface 14 of golf club head 10 is prepared for the coating process by known preparation procedures which include but are not limited to sandblasting titanium striking surface 14 and then acid etching titanium striking surface 14 to ensure that titanium striking surface 14 is clean. Titanium striking surface 14 is further cleaned by degreasing the surface using conventional degreasing procedures.

A first metal composition is prepared and is intended to be disposed on titanium striking surface 14 to, in part, form the coated titanium striking surface 14 of the present invention. The first metal composition is preferably a combination of several metal powders, wherein the powders are selected from the group consisting of silver, nickel, copper, cobalt, chrome, vanadium, zirconium, tungsten, titanium hydride, copper phosphorous and molybdenum. When molybdenum is included in the first composition, a shiny surface on titanium striking surface 14 is formed thereon during the present brazing process. It being understood that the aforementioned metal powders are merely listed as being exemplary in nature and other metal powders may be used in forming the brazing composition of the present invention. In a preferred embodiment, the first metal composition comprises a composition substantially formed of silver, nickel, copper and titanium hydride powders. In an exemplary embodiment, the preferred first composition comprises about 20% copper, about 10% nickel, about 60% silver, and about 10% titanium hydride, all measured by weight. Suitable ranges for metals comprising the preferred first composition are as follows: copper in an amount from about 20% to about 30%, nickel in an amount from about 10% to about 30%, silver in an amount from about 60% to about 80%, and titanium hydride in an amount from about 1% to about 10%, wherein all amounts are by weight.

The metal powders comprising the first composition are thoroughly mixed with one another by known procedures, including a ball milling process, in which the metal powders are mixed and the particle size of the powders is reduced to a generally homogenous particle size. Preferably, the first composition is reduced to a particle size of about 325 mesh or smaller.

A plurality of hard particles 20 is mixed with the first milled metal composition to form a second composition of the present invention. The plurality of hard particles 20 includes but is not limited to boron compounds; alumina compounds; partially stabilized zirconia; carbides, including tungsten carbide, chrome carbide, vanadium carbide, boron carbide, complex carbides, silicon carbide, ceramics, beryllium compounds, and other naturally occurring minerals. More preferably, the plurality of hard particles 20 comprises a plurality of diamond particles having a particle size from about 1 micron to about 40 micron. In a preferred embodiment, the second metal composition comprises 0.2 grams of diamond particles for every 3 grams of the first metal composition. Diamond particles 20 comprise from about 5% to about 80% by volume of the brazing composition. Preferably, diamond particles 20 comprise about 25% by volume of the entire brazing composition.

A first solution is added to the milled second metal composition including the plurality of diamond particles 20 to form a brazing composition of the present invention which is intended to be applied to the titanium striking surface 14. The first solution is added to the second metal composition in an amount which permits the second composition to be easily applied to titanium striking surface 14. In other words, by adding the first solution to the second composition, a slurry (or paste like material) is formed. One preferred first solution comprises a suitable oil composition, such as mineral oil. Other suitable first solutions are petroleum products, alcohols, and kerosene. The first solution acts as a vehicle for applying the brazing composition onto titanium striking surface 14 by forming a slurry or thick paste which can be easily applied to titanium striking surface 14. During the vacuum furnace process described in greater detail hereinafter, the first solution evaporates from the brazing composition as the brazing composition sets on titanium striking surface 14. In an exemplary embodiment, the ratio between the second composition and the first solution is about 10:1 by weight.

The brazing composition is applied to titanium striking surface 14 by suitable methods including the application of the brazing composition with a brush. Preferably, the brazing composition is applied to titanium striking surface 14 so that about 60% by volume of the diamond particles 20 is encapsulated by the metal powders which comprise the first composition. In any event, because a portion of diamond particles 20 should protrude above the brazed metal powders which form a matrix for retaining diamond particles 20, the thickness of the brazed metal powders should not be greater than the thickness of the diamond particles 20.

After the brazing composition is disposed on titanium striking surface 14, golf club head 10 is subjected to a vacuum furnace process. The vacuum furnace includes a vessel which receives golf club head 10 and which is sealed to the surrounding environment. The vessel itself and contents are subjected to a vacuum process and a heating process. In an exemplary process, the vacuum is drawn down to about $10^{-8}$ torr and golf club head 10 is heated to about 1680° F. at a rate of approximately 300° F. per minute. The temperature of about 1680° F. represents a target temperature which comprises a low processing temperature to set the brazing composition onto titanium striking surface 14 without having appreciable deterioration of diamond particles 20. As is known in the related art, the processing of diamond particles in an open environment exceeding about 1200° F. causes the diamond particles to begin to deteriorate to a carbon form due to exposure to excessive heat. The present invention is capable of heating diamond particles 20 to about 1680° F. without appreciable deterioration of diamond particles 20 because the brazing process occurs in a vacuum environment. Once the vacuum furnace obtains a temperature of about 1680° F., the temperature of the vessel is held for a predetermined amount of time to permit the brazing composition to braze to titanium striking surface 14. Preferably, the predetermined amount of time is about 3 minutes. It is desirable to have a temperature rate which represents the fastest processing time but at the same time ensures that the brazing material effectively sets on titanium striking surface 14 producing an effective bond therebetween. Lower temperature rates are suitable but have the associated disadvantage that by subjecting diamond particles 20 to higher temperatures, e.g., greater than about 1200° F., the likelihood that diamond particles 20 are deteriorated due to exposure to excessive heat is increased because diamond particles 20 are exposed to such high temperatures for a greater period of time. Similarly, the holding time period represents a minimum holding time which permits the brazing composition to set onto titanium striking surface 14 and at the same time, diamond particles 20 do not appreciable deteriorate due to the elevated temperatures of the process. After the holding period expires, nitrogen gas is then pumped into the vessel and the vessel is cooled down to 200° F. Golf club head 10 is then removed from the vessel and cools to room temperature.

In accordance with the present invention, a brazing composition is applied to striking surface 14 by using the aforementioned brazing process. It has been found that the brazing composition and the brazing process of the present invention provide a coating which securely adheres to titanium striking surface 14. A hard, durable surface is provided on titanium striking surface 14 by disposing the plurality of hard particles 20 and brazing solution onto titanium striking surface 14. By providing a hard surface on titanium striking surface 14, the life of golf club head 10 is increased and the hard striking surface improves the driving capability of a golf ball as it impact the coated titanium striking surface 14.

Importantly, the process of the present invention permits materials to be applied to titanium striking surface 14 without having a weak interface between the applied materials and the titanium striking surface 14. As previously, mentioned, titanium and titanium alloy materials are very difficult to work with and materials conventionally applied to a titanium striking surface 14 generally lacked the necessary bonding thereto which resulted in the materials not adhering to the titanium striking surface 14 or if the materials bonded, a very weak bond resulted and the materials over time and use would easily detach from titanium striking surface 14.

In another aspect of the present invention, diamond particles 20 comprise coated diamond particles. The use of coated diamond particles is known in the relevant arts. Exemplary and preferred coatings for diamond particles 20 include but are not limited to nickel, titanium, ceramic materials, or a combination thereof. By coating diamond particles 20, the coatings help to retain diamond particles 20 within the metallic matrix formed by the metal powders of the brazing composition. Furthermore, the coatings help protect diamond particles 20 from heat damage at elevated temperatures, thereby reducing the deterioration of diamond particles 20.

Figure 3:
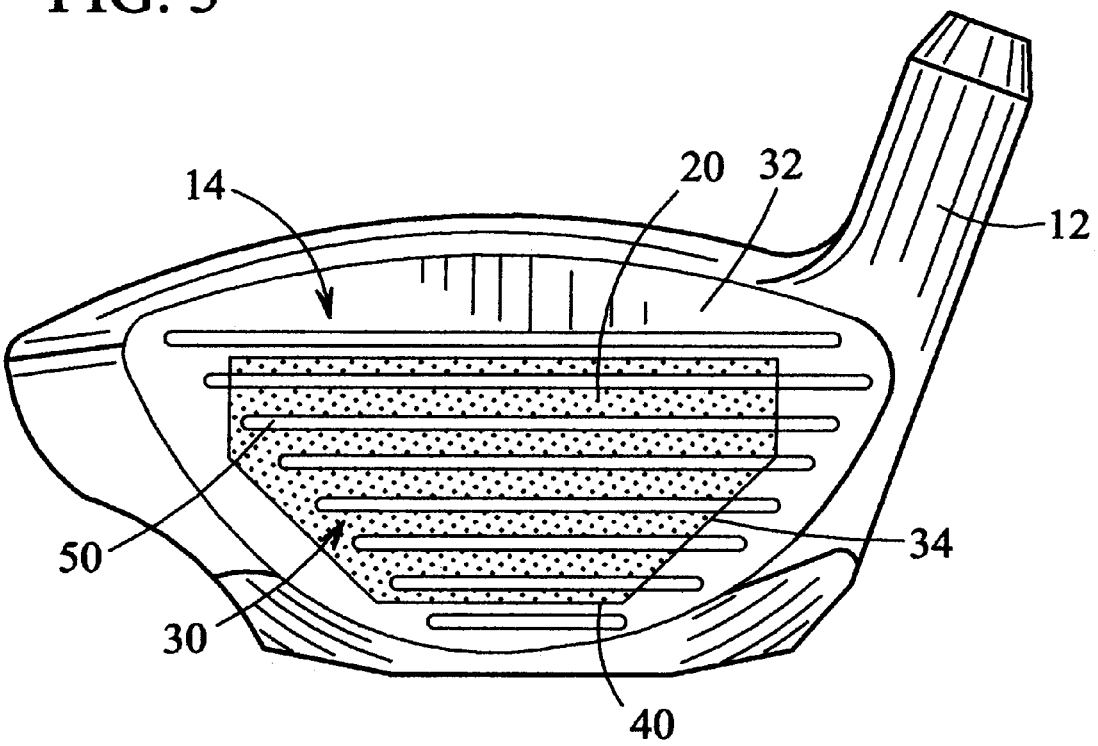
FIG. 3 is front perspective view of a golf club head having a titanium or titanium alloy insert including the brazing composition of the present invention applied to a first surface thereof.

Now turning to FIG. 3, which illustrates yet another aspect of the present invention. Golf club head 10 includes a forward face 32 which, in part, comprises titanium striking surface 14 which impacts a golf ball when a golfer strikes the golf ball. Formed in forward face 32 is an insert receiving recess 34 formed rearwardly into golf club head 10 from forward face 32. It is within the scope of the present invention that insert receiving recess 34 may take a variety of sizes and shapes and the generally rectangular insert receiving recess 34 shown in FIG. 2 is merely exemplary in nature and not limiting. Insert receiving recess 34 receives a coated titanium insert 30 which is similarly shaped as insert receiving recess 34 and preferably coated titanium insert 30 is centered about a predetermined sweet spot formed on forward face 32 of golf club head 10.

In this embodiment, titanium in-lert 30 may be produced in accordance with the present invention, wherein titanium insert 30 includes a first surface 40 and an opposing second surface (not shown). The brazing composition of the present invention is disposed on first surface 40 of titanium insert 30 using the aforementioned brazing process. More specifically, after preparing the brazing composition, it is applied to first surface 40 of titanium insert 30 prior to titanium insert 30 being placed into the vacuum furnace and subjected to the present brazing process. As a result of the brazing process, the brazing composition including the plurality of hard particles 20 is securely disposed on first surface 40. The second surface is disposed within insert receiving recess 34 so that it preferably seats flush against insert receiving recess 34.

In accordance with the present invention, titanium insert 30 may be disposed in either an iron type golf club or a wood type golf club. Titanium insert 30 optionally includes score lines 50 formed therein. It being understood that titanium insert 30 may take a variety of shapes and dimensions and titanium insert 30 of FIG. 3 is shown for purpose of illustration and is exemplary in nature.

While preferred embodiments have been shown and described, various modifications and substitutions may be made thereto without departing from the spirt and scope of the present invention. Accordingly, it is to be understood that the present invention has been described by way of illustrations and not limitations.

What is claimed:

1. A process for coating a titanium or titanium alloy striking surface of a golf club head, comprising:

forming a first composition formed of a combination of at least two metal powders;

adding a plurality of hard particles to the first composition to form a second composition;

forming a brazing composition by adding a first solution to the second composition;

disposing the brazing composition on the titanium or titanium alloy striking surface of the golf club head; and disposing the coated titanium or titanium alloy golf club head in a vacuum furnace, wherein the titanium or titanium alloy striking surface with the brazing composition disposed thereon is subjected to a predetermined vacuum pressure and is heated to a first predetermined temperature at a predetermined rate and is held at the first predetermined temperature for a predetermined period of time before removing the vacuum pressure and cooling the golf club head to a second predetermined temperature.

2. The process as set forth in claim 1, wherein the first composition is reduced to a predetermined homogenous particle size by a milling process.

3. The process as set forth in claim 2, wherein the predetermined particle size is about 325 mesh or smaller.

4. The process as set forth in claim 1, wherein the first solution comprises an oil based solution.

5. The process as set forth in claim 1, wherein the plurality of hard particles comprises diamond particles having a particle size from about 1 micron to about 40 micron.

6. The process as set forth in claim 1, wherein the predetermined vacuum pressure is about $10^{-8}$ torr.

7. The process as set forth in claim 1, wherein the first predetermnined temperature is about 1680° F.

8. The process as set forth in claim 1, wherein the predetermined temperature rate is about 300° F. per minute.

9. The process as set forth in claim 1, wherein the second predetermined temperature is about 200° F.

10. The process as set forth in claim 5, wherein the second composition comprises 0.2 grams of diamond particles per 3 grams of the first composition.

11. The process as set forth in claim 1, wherein the golf club head is cooled after the predetermined holding time by introducing nitrogen gas into the vacuum furnace.

12. The process as set forth in claim 1, wherein the holding period is about 3 minutes.

13. The process as set forth in claim 5, wherein the diamond particles are coated with a material selected from the group consisting of nickel, titanium, and ceramic.

14. A process for coating a titanium or titanium alloy striking surface of a golf club head comprising:

forming a first composition formed of a combination of at least two metal powders;

adding a plurality of hard particles to the first composition to form a second composition;

forming a brazing composition by adding a first solution to the second composition;

disposing the brazing composition on the titanium or titanium alloy striking surface of the golf club head; and disposing the coated titanium or titanium alloy golf club head in a vacuum furnace, wherein the titanium or titanium alloy striking surface with the brazing composition disposed thereon is subjected to a predetermined vacuum pressure and is heated to a first predetermined temperature at a predetermined rate and is held at the first predetermined temperature for a predetermined period of time before removing the vacuum pressure and cooling the golf club head to a second predetermined temperature, wherein the first composition comprises a mixture of silver, nickel, copper, and titanium hydride.

15. The process as set forth in claim 14, wherein the first composition comprises about 20% by weight of copper, 10% by weight of nickel, 60% by weight of silver, and 10% by weight of titanium hydride.

16. A process for coating a titanium or titanium alloy striking surface of a golf club head, comprising:

forming a first composition formed of a combination of at least two metal powders;

adding a plurality of diamond particles to the first composition to form a second composition;

forming a brazing composition by adding a first solution to the second composition;

disposing the brazing composition on the titanium or titanium alloy striking surface of the golf club head; and disposing the coated titanium or titanium alloy golf club head in a vacuum furnace, wherein the titanium or titanium alloy striking surface with the brazing composition disposed thereon is subjected to a predetermined vacuum pressure and is heated to a first predetermined temperature at a predetermined rate and is held at the first predetermined temperature for a predetermined period of time before removing the vacuum pressure and cooling the golf club head to a second predetermined temperature, wherein the plurality of diamond particles comprises from about 5% to about 80% by volume of the brazing composition.

17. A process for forming a coated titanium or titanium alloy insert for use in a golf club head, comprising:

preparing a first composition formed of a combination of at least two metals;

adding a plurality of hard particles to the first composition to form a second composition;

preparing a brazing composition by combining the second composition with a first solution;

disposing the brazing composition on the titanium or titanium alloy insert; and disposing the coated titanium or titanium alloy insert in a vacuum furnace, wherein the titanium or titanium alloy insert with the brazing composition disposed thereon is subjected to a predetermined vacuum pressure and is heated to a first predetermined temperature at a predetermined rate and is held at the first predetermined temperature for a predetermined period of time before removing the vacuum and cooling the titanium or titanium alloy insert to a second predetermined temperature.

* * * * *